US006092700A

United States Patent [19]

Orihel et al.

[11] Patent Number: 6,092,700

[45] Date of Patent: Jul. 25, 2000

[54] NOZZLE FOR INTRODUCING LIQUID METAL INTO A MOLD FOR THE CONTINUOUS CASTING OF METALS

[75] Inventors: Fabienne Orihel, Clouange; Bernard Goncalves, Saulnes; Laurent Gacher, Sarreguemines; Frédéric Descaves, Isbergues; Johan Richaud, St Martin de Castillon, all of France

[73] Assignees: Usinor, Pauteaux; Vesuvius France, Feignies, both of France

[21] Appl. No.: 09/277,166

[22] Filed: Mar. 26, 1999

[30] Foreign Application Priority Data

Apr. 18, 1998 [FR] France ..... 98 04706

[51] Int. Cl.[7] ..... B22D 41/50

[52] U.S. Cl. ..... 222/594; 222/606

[58] Field of Search ..... 222/591, 594, 222/606; 164/437, 337

[56] References Cited

U.S. PATENT DOCUMENTS 5,733,469 3/1998 Damasse et al. ..... 222/594

FOREIGN PATENT DOCUMENTS 0 765 702 4/1997 European Pat. Off. .
0 771 600 5/1997 European Pat. Off. .
1094517 5/1955 France .
60-021171 2/1985 Japan .
1-317658 3/1990 Japan .
7-290203 3/1996 Japan .

*Primary Examiner*—Scott Kastler
*Attorney, Agent, or Firm*—Nixon Peabody LLP; Thomas W. Cole

[57] ABSTRACT

The subject of the invention is a nozzle (1) for introducing a liquid metal into a mold for the continuous casting of metals, of the type comprising a tubular first part (2), one end of which is intended to be connected to a vessel containing said liquid metal and the other end of which emerges in a hollow second part (4) of elongate shape, at least one portion of the internal space (3) of which is oriented approximately perpendicular to said tubular first part (2), said hollow part (4) having an outlet (5, 6) at each of its ends, as well as one or more outlet orifices (7–17) provided in its bottom (18) and/or its lateral walls, a bar provided with holes (22, 22', 23–34) being placed in the internal space (3) of said hollow part (4) so that the liquid metal necessarily passes via said holes (22, 22', 23–34) before passing through said outlet orifices (7–17), wherein said bar (19, 38, 39, 41, 43) includes, on at least one portion of the width of its upper face, a raised part (20, 37, 42, 44) whose top lies along the longitudinal horizontal axis of said hollow part (4), said holes (22, 22', 23–34) being distributed on each side of said top.

8 Claims, 1 Drawing Sheet

NOZZLE FOR INTRODUCING LIQUID METAL INTO A MOLD FOR THE CONTINUOUS CASTING OF METALS

FIELD OF THE INVENTION

The invention relates to the continuous casting of metals. It relates more particularly to the refractory nozzles via which the liquid metal to be cast, such as steel, is introduced into the mold of a continuous casting plant, especially for twin-roll casting.

These nozzles are connected via their upper end to the vessel serving as reservoir of liquid metal, called a tundish, and their lower end dips into the pool of liquid metal present in the mold where the solidification of the cast product must be initiated. The primary role of these nozzles is to protect the jet of liquid metal from atmospheric oxidation as it travels between the vessel and the mold. They also allow, by virtue of suitable configurations of their lower end, the flows of liquid metal into the mold to be favorably oriented so that solidification of the product takes place under the best possible conditions.

The casting of thin metal strip a few mm in thickness directly from liquid metal (for example steel or copper) can be carried out on a so-called "twin-roll casting" plant. It comprises a mold, the casting space of which is bounded on its long sides by a pair of internally cooled rolls, which have parallel horizontal axes and rotate about these axes in opposite directions, and on its short sides by refractory closure plates (called side walls) which are applied against the ends of the rolls. The rolls may also be replaced by cooled endless belts.

PRIOR ART

In twin-roll casting, two-part nozzles are often used (see, for example, document EP-A-0 771 600). The first part is composed of a cylindrical tube, the upper end of which is connected to an orifice made in the bottom of the tundish which constitutes the reservoir of liquid steel feeding the mold. If required, this orifice can be partially or completely closed off by the operator, using a stopper rod or a slide valve system which regulates the flow rate of metal. The maximum flow rate of metal which can flow into the nozzle depends on the cross section of this orifice. The second part, fixed to the lower end of the above tube, for example by screwing, or by being structurally integrated into it, is intended to be immersed in the pool of liquid metal present in the mold. It is composed of a hollow element inside which emerges the lower orifice of the above cylindrical tube. The internal space of this hollow element has a more or less elongate general shape depending on the dimensions of the casting space of the machine onto which the nozzle has to be fitted. This hollow element is oriented approximately perpendicular to the tube. When the nozzle is in service, the hollow element is placed parallel to the rolls and the liquid metal flows into the mold via outlets made on the sides of the hollow element, generally at each of its ends. In the latter case, the flows of metal leaving the nozzle are thus preferably directed toward the side walls, so as to bring hot metal onto their surfaces and thus prevent undesirable solidification of metal (so-called "parasitic solidification") from occurring thereon, which would seriously disrupt the operation of the machine. The outlets may have a horizontal or downward oblique orientation. Various orifices smaller than these outlets may also be provided on the lateral walls and/or the bottom of the nozzle so as to feed hot metal directly to those regions of the mold which lie on the ides of the nozzle and/or under it. The aim is thus, in particular, to improve the thermal homogeneity of the metal present in the mold.

One of the main difficulties encountered in the use of these nozzles is that, in general, the liquid metal does not completely fill their internal space and the flow of metal therein often takes place in an irregular and turbulent manner. This is particularly the case when the orifice of the tundish is not fully open. This results in the streams of metal leaving the outlets being highly unstable and the flows inside the mold depart from their optimum configuration that the nozzle is theoretically designed to impose. It is then found that irregularities appear in the solidification of the product, which can seriously affect its final quality, most particularly if thin strip is being cast.

This problem is remedied by inserting obstacles in the internal space of the nozzle, these obstacles forcing the metal to suffer head losses counter to its natural flow. For the same flow rate of liquid metal, the speed of the flow is reduced and the filling of the internal space of the nozzle is thus improved. In this way, any erratic variation in the flow of metal outside the nozzle is lessened. In the case of the abovementioned two-part nozzles, these obstacles may be inserted into the cylindrical first part or in its extension (see document EP-A-0,765,702). They may also comprise a "bar", i.e. an elongate parallelepipedal element made of porous or perforated refractory placed inside the second part of the nozzle (the hollow element), through which the liquid metal must necessarily pass before reaching all or some of the various orifices emerging inside the casting space of the mold (see document JP-A-1-317,658).

If the nozzle includes, on the one hand, a perforated bar and, on the other hand, orifices provided in the bottom and/or the lateral walls of its elongate second part (in addition to the outlets directed toward the side walls of the casting space), it is important for these various orifices to be fed with liquid metal in a homogeneous manner over the entire length of said second part. It is only if this condition is met that satisfactory homogeneity of the flows of metal inside the casting space can be guaranteed. However, tests on hydraulic mock-ups show that this condition is generally not satisfied when a nozzle of highly elongate shape is used, especially one designed to be used on a plant for casting thin strip of large width (of the order of 1 m, and more) and equipped with a parallelepipedal perforated bar. It is found that metal flows through some of the holes in the nozzle with a high flow rate, while it flows through other holes with an insufficient flow rate. This is detrimental to proper feeding of the entire casting space with hot metal and can lead to irregularities in the solidified thickness of the product on the rolls, this being an essential parameter in the quality of the final strip.

SUMMARY OF THE INVENTION

The object of the invention is to propose a nozzle configuration of the type which has just been described, which feeds metal into the casting space as homogeneously as possible over its entire length.

For this purpose, the subject of the invention is a nozzle for introducing a liquid metal into a mold for the continuous casting of metals, of the type comprising a tubular first part, one end of which is intended to be connected to a vessel containing said liquid metal, and the other end of which emerges in a hollow second part of elongate shape, at least one portion of the internal space of which is oriented approximately perpendicular to said tubular first part, said hollow part having an outlet at each of its ends, as well as one or more outlet orifices provided in its bottom and/or its lateral walls, a bar provided with holes being placed in the internal space of said hollow art so that the liquid metal necessarily passes via aid holes before passing through said outlet orifices, herein said bar includes, on at least one portion of the width of its upper face, a raised part whose top lies along the longitudinal horizontal axis of said hollow part, said holes being distributed on each side of said top.

As will have been understood, the invention consists in providing, on the upper face of the bar, a raised part over at least a portion of its width. This raised part must have an approximately triangular or rounded cross section so as to "splay" the jet of metal which strikes it and to distribute said metal symmetrically over the cross section of the nozzle, while preventing it from rebounding vertically and disturbing the regularity of the flows. This results in filling that is more homogeneous and more constant over time than is obtained with a bar of simply parallelepipedal shape which presents a simple horizontal plane surface to the jet of liquid metal striking it.

BRIEF DESCRIPTION OF THE DRAWINGS

The invention will be more clearly understood thanks to the description which follows, given with reference to the following appended figures.

DESCRIPTION OF THE PREFERRED EMBODIMENTS

Figures 1A, 1B, 1C, 2, 3, 4, 5:
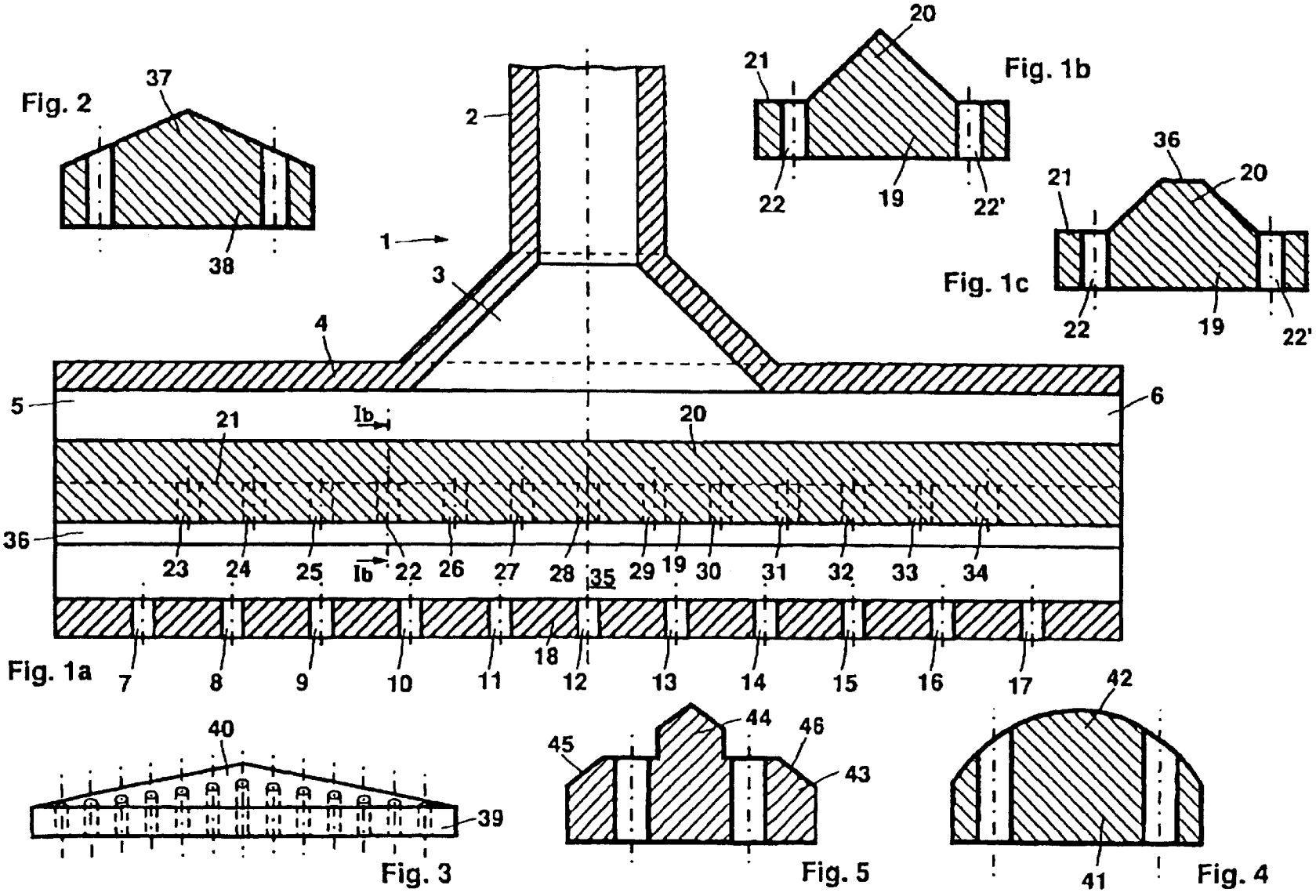
FIG. 1*a* which shows, in front view and in longitudinal section, an example of a nozzle according to the invention, FIG. 1*b* which shows, in side view and in cross section on 1*b*—1*b,* the bar in FIG. 1*a*, and FIG. 1*c* which shows, in the same way, an alternative form of the bar in FIG. 1*a;*
FIG. 2 which shows, in side view and in cross section, a second example of a bar, which can substitute for that in FIG. 1*a;*
FIG. 3 which shows, in side view and in cross section, a third example of a bar which can substitute for that in FIG. 1*a;*
FIG. 4 which shows, in side view and in cross section, a fourth example of a bar which can substitute for that in FIG. 1*a*.
FIG. 5 which shows, in side view and in cross section, a fifth example of a bar which can substitute for that in FIG. 1*a*.

The nozzle 1 according to the invention, shown in FIG. 1*a*, is, by virtue of its narrow and elongate shape, particularly suitable for use on a plant for casting thin strip between two internally cooled and rotating rolls, according to a currently well-known process. As in the prior art described above, it includes a first part composed of a cylindrical tube 2, the upper end (not shown) of which is intended to be connected to the outlet orifice of a tundish. This cylindrical tube 2 emerges in the internal space 3 of the second part of the nozzle 1, composed of a hollow element 4 of elongate shape, which is sufficiently narrow to allow it to be inserted into the casting space of the plant. According to the prior art, this hollow element 4 has various orifices via which the liquid metal can leave the nozzle 1, namely:

two outlets 5, 6 of rectangular cross section in the example shown, these being each provided at one end of the hollow element 4 and intended to be directed toward the side walls of the casting space, through which outlets most of the stream of liquid metal passing through the nozzle 1 will travel; in the example in FIG. 1*a*, these outlets 5, 6 are oriented horizontally, but they may also be oriented obliquely; they may also have, conventionally, a cross section of different shape (for example circular);

a series of small-diameter cylindrical outlet orifices 7–17 oriented vertically, provided in the mid-plane of the bottom 18 of the hollow element 4 and intended to feed hot metal directly into those regions of the casting space which lie below the nozzle; as a variant, it is possible, as is known from document EP-A-0,771,600, to provide not one but two series of such orifices, each series being placed on either side of the mid-plane of the bottom 18 of the hollow element 4.

Another variant would consist in adding, to the outlet orifices 7–17 (or in substituting for them), orifices provided in the long lateral walls of the hollow element 4 and directed toward the long sides of the casting space (in other words, toward the rolls in the case of a twin-roll casting plant). These orifices 7–17 may also not be strictly cylindrical, but have, for example, an elliptical cross section. They may also (especially according to one of the variants in EP-A-0,771,600), be oriented obliquely. Finally, they may be replaced by one or more slots, each extending over all or part of the length of the bottom 18 of the hollow element 4, for which it would be important for the slots to be fed homogeneously over their entire length.

The nozzle 1 also includes, placed in its internal space 3, a perforated bar 19 which rests on shoulders 36 provided on the walls of the outlets 5, 6. Its function is, as is known, to create head losses in the liquid metal so as to obtain better filling of the internal space 3 and thus to regularize the flows of liquid metal outside the nozzle 1. According to the invention, this bar 19 has a shape different from the conventional parallelepipedal shape in that it includes a raised part 20, the top of which is intended to lie along the longitudinal horizontal axis of the hollow part 4 of the nozzle 1. In the example shown in FIGS. 1*a* and 1*b,* this raised part 20 relates only to the central portion of the width of the upper face 21 of the bar 19, and has a triangular cross section whose dimensions do not vary along the length of the bar 19. The remaining parts of this upper face 21 are plane, and it is on these plane parts, level with the raised part 20, that the holes 22, 22', 23–34 are provided, the liquid metal having to pass through these holes before reaching the lower part 35 of the internal space 3 of the nozzle 1, and then flowing out of the nozzle 1 through the lower part of the outlets 5, 6 and the orifices 7–17. In the configuration shown, some of the metal may flow out of the nozzle 1 via the upper part of the outlets 5, 6, and therefore without having passed through the holes 23–34 in the bar 19. However, according to the invention, the metal which flows out of the nozzle 1 via the outlet orifices 7–17 must necessarily have passed, beforehand, through the holes 23–34 in the bar 19.

As a variant, as shown in FIG. 1*c*, the cross section of the raised part 20 of the bar 19 may have the shape of a triangle, the apex of which has been cut flat and thus has, at its top, a plane part 36.

It goes without saying that the representation of the nozzle 1 is merely schematic and that only the elements and details necessary for understanding the invention are depicted therein. In particular, in order not to clutter up FIG. 1*a*, the manner in which the various parts of the nozzle 1 are joined together has not been shown, this manner not being distinguished from that which is usual for this kind of nozzle. For example, the cylindrical tube 2 and the hollow element 4 may be fixed to each other by screwing.

Likewise, the external shape of the hollow element 4 of the nozzle 1 is merely a nonlimiting example and can be modified.

FIG. 2 shows a variant of the bar according to the invention, in which the raised part 37, of triangular cross section, covers the entire width of the bar 38. The top of the raised part 37 may also be cut flat, in a similar way to that seen in the variant in FIG. 1*c*. FIG. 3 shows a variant of the configuration in FIG. 2: the bar 39 has a raised part 40 of triangular cross section, and the thickness of which decreases between its middle and its ends. This variable-thickness configuration of the raised part 40 may also be adapted to the case in FIG. 1, in which the raised part 20 covers only the central portion of the width of the bar 19. By means of this variant, it is sought, if necessary, to avoid the orifices lying near the ends of the nozzle 1 from being fed insufficiently compared with the orifices lying close to its central part, and therefore vertically in line with the pouring jet, particularly if a very long nozzle is used (for example, about 700 mm in length).

FIG. 4 shows an example of a bar 41 whose raised part 42 no longer has a triangular cross section but a rounded cross section. Here too, the raised part 42 may cover the entire upper face of the bar 40 (as shown), or only a portion of this upper face, and its thickness may be identical over the entire length of the bar 40, or may decrease between its central part and its ends.

Finally, FIG. 5 shows an example of a bar 43 in which the raised part 44 covers only a central portion of the upper surface of the bar 43 and has a rectangular cross section at its base and a triangular cross section at its top. Moreover, said upper surface has beveled edges 45, 46.

The examples of bars which have been described and shown are not limiting, and other configurations may be imagined, for example by combining essential characteristics of the previous examples. What is more, the position of the bar may be modified depending on the internal geometry of the nozzle. Instead of being placed inside the outlets, as shown, it may be placed entirely above or below the outlets, the essential point being that the liquid metal must pass through it before flowing out of the nozzle via the outlet orifices provided in the bottom of the hollow element. The nozzle may also include other obstacles, in addition to the bar.

It is also conceivable that all the holes in the bar do not have the same diameter, and/or are placed at irregular distances from each other, if it is observed that this helps to further improve the distribution of liquid metal leaving the bottom of the nozzle. Likewise, the holes may not be strictly vertical, but oblique.

By way of example, the following test results may be given. They were obtained on a hydraulic mock-up which reproduces the configurations of a nozzle 1, the hollow element 4 of which has a length of 700 mm and an internal width of 54 mm, and is provided with a bar having this same length and this same width. In the reference configuration, the bar has a strictly parallelepipedal shape and a thickness of 20 mm. It includes two rows of cylindrical holes 12 mm in diameter, the axes of which are placed at a distance of 15 mm from the edges of the bar. The distance between the axes of these holes is 24 mm and the axes of the holes closest to the ends of the bar are located at 35 mm from said ends. In the configuration according to the invention, the bar is of the type 19 shown in FIGS. 1*a* and 1*b*, with a raised central part of triangular cross section 20, the top of which projects above the upper face of the bar 19 by 20 mm. The holes are provided in the same way as in the case of the reference bar. The bottom of the hollow element 4 has, in both cases, a central row of 26 orifices comparable to the orifices 7–17 in FIG. 1*a*. In the mock-up, the amount of water traveling through the nozzle 1, which emerged therefrom via each of the outlets 5, 6 and via each of the holes in the bottom of the hollow element 4, was measured. The results of the measurements are given in Table 1. The orifices have been numbered going from one end of the nozzle 1 to the other, holes No. 13 and 14 lying on each side of the vertical axis of the nozzle 1.

TABLE 1

Distribution of the flow of liquid leaving the nozzle between the outlets and the orifices

| Reference bar | | Bar of the invention | |
|---|---|---|---|
| No. of the orifice | % of the total flow emerging via it | No. of the orifice | % of the total flow emerging via it |
| Left outlet | 25.5 | Left outlet | 21.2 |
| 1 | 2.2 | 1 | 2.3 |
| 2 | 2.1 | 2 | 2.3 |
| 3 | 2.1 | 3 | 2.3 |
| 4 | 2.0 | 4 | 2.2 |
| 5 | 2.1 | 5 | 2.3 |
| 6 | 2.1 | 6 | 2.3 |
| 7 | 1.2 | 7 | 2.2 |
| 8 | 2.0 | 8 | 2.2 |
| 9 | 1.9 | 9 | 2.1 |
| 10 | 1.7 | 10 | 2.0 |
| 11 | 0.9 | 11 | 1.8 |
| 12 | 1.6 | 12 | 1.7 |
| 13 | 2.6 | 13 | 3.0 |
| 14 | 2.6 | 14 | 3.0 |
| 15 | 1.6 | 15 | 1.7 |
| 16 | 0.9 | 16 | 1.8 |
| 17 | 1.7 | 17 | 2.0 |
| 18 | 1.9 | 18 | 2.1 |
| 19 | 2.0 | 19 | 2.2 |
| 20 | 1.2 | 20 | 2.2 |
| 21 | 2.1 | 21 | 2.3 |
| 22 | 2.1 | 22 | 2.3 |
| 23 | 2.0 | 23 | 2.2 |
| 24 | 2.1 | 24 | 2.3 |
| 25 | 2.1 | 25 | 2.3 |
| 26 | 2.2 | 26 | 2.3 |
| Right outlet | 25.5 | Right outlet | 21.2 |
| Total | 100.0 | Total | 100.0 |

In the reference configuration, the orifices in the bottom of the nozzle are fed very unequally: the proportion of the liquid flow which passes through them varies from 0.9 to 2.6% (0.9 to 2.2% if the two central orifices, numbered 13 and 14, are ignored, it being normal for these to be fed preferably since they lie vertically in line with the pouring jet). It may be seen that even two adjacent orifices may be fed with very different flows. In the configuration of the bar according to the invention, the scatter in the flows is much less: they vary from 1.7 to 3.0% (1.7 to 2.3% if the central orifices are ignored).

As was stated, the nozzle according to the invention is preferably applied in plants for the twin-roll continuous casting of thin steel strip. However, it may also be used on plants for the continuous casting of metallurgical products of other shapes and sizes and/or of other metals, for which it is useful for metal to be fed very uniformly into the casting space.

What is claimed is:

1. A nozzle for introducing a liquid metal into a mold for continuously casting a metal, comprising:

a tubular first part having one end for connection to a vessel containing said liquid metal, and an opposite end including a hollow second part of elongate shape having an internal space which is oriented approximately perpendicular to said tubular first part, said hollow part having a bottom wall provided with one or more outlet orifices, wherein said second hollow part includes a bar provided with holes disposed across the internal space of said hollow part so that liquid metal flowing through said nozzle must necessarily pass through said bar holes before passing through said outlet orifices.

2. The nozzle as claimed in claim 1, wherein said bar includes an upper face having a raised part of triangular cross-section.

3. The nozzle as claimed in claim 2, wherein said raised part is of triangular cross section.

4. The nozzle as claimed in claim 2, wherein the cross section of the upper face of said bar is triangular in a central part and flat in lateral parts flanking said central part and wherein said holes are provided in said lateral parts.

5. The nozzle as claimed in claim 2, wherein said raised part of said bar has a cross section of rounded shape.

6. The nozzle as claimed in claim 2, wherein the upper face of said bar has beveled edges.

7. The nozzle as claimed in claim 2, wherein said raised part of the bar has a varying thickness which decreases between a center and ends of the bar.

8. The nozzle as claimed in claim 2, wherein said raised part of triangular cross section has an apex that is truncated to a flat surface.

* * * * *

UNITED STATES PATENT AND TRADEMARK OFFICE

CERTIFICATE OF CORRECTION

PATENT NO. : 6,092,700

DATED : Jul. 25, 2000

INVENTOR(S) : ORIHEL et al.

It is certified that error appears in the above-identified patent and that said Letters Patent is hereby corrected as shown below:

Under Foreign Application Priority Data, please delete "April 18, 1998" and replace it with –April 16, 1998–.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*